US006835047B2

(12) United States Patent
Gerlach et al.

(10) Patent No.: US 6,835,047 B2
(45) Date of Patent: Dec. 28, 2004

(54) LABYRINTH SEAL ADAPTER FOR MARINE PROPELLER

(75) Inventors: Charles L. Gerlach, Kentwood, MI (US); Benjamin D. Curtis, Hudsonville, MI (US)

(73) Assignee: Michigan Wheel Corporation, Grand Rapids, MI (US)

( * ) Notice: Subject to any disclaimer, the term of this patent is extended or adjusted under 35 U.S.C. 154(b) by 0 days.

(21) Appl. No.: 10/291,922

(22) Filed: Nov. 12, 2002

(65) Prior Publication Data

US 2004/0091356 A1 May 13, 2004

Related U.S. Application Data

(60) Provisional application No. 60/350,471, filed on Nov. 13, 2001.

(51) Int. Cl.[7] ..... F01D 11/00
(52) U.S. Cl. ..... 416/174; 416/93 A
(58) Field of Search ..... 416/174, 93 A, 416/129 A, 245 A, 146 R; 415/17, 34–35; 440/80, 89

(56) References Cited

U.S. PATENT DOCUMENTS 2,948,252 A * 8/1960 Alexander Jr. ..... 416/93 R
3,092,185 A * 6/1963 Alexander Jr. ..... 416/193 R
3,092,393 A 6/1963 Morley et al.
3,251,601 A 5/1966 Harvey
3,434,447 A * 3/1969 Christensen et al. ..... 440/66
3,556,041 A 1/1971 Shimanckas
3,563,670 A 2/1971 Knuth
3,567,334 A 3/1971 Lorenz
3,640,642 A 2/1972 Kress et al.
3,762,359 A 10/1973 Jones, Jr.
3,788,267 A * 1/1974 Strong ..... 440/66
3,796,514 A 3/1974 DuFrene
3,871,324 A 3/1975 Snyder
4,180,368 A * 12/1979 Henrich et al. ..... 416/146 R
4,604,068 A 8/1986 Guinn
4,778,419 A * 10/1988 Bolle et al. ..... 440/89 R
5,201,679 A 4/1993 Velte, Jr. et al.
5,352,141 A * 10/1994 Shields et al. ..... 440/80

* cited by examiner

*Primary Examiner*—Edward K. Look
*Assistant Examiner*—James M. McAleenan
(74) *Attorney, Agent, or Firm*—Barry C. Kane; Miller Johnson Snell & Cummiskey, P.L.C.

(57) ABSTRACT

A seal adapter for reducing the escape of exhaust gases between an outboard motor and a propeller includes a substantially hollow cylindrical connecting member (71) having a shoulder (84) for dividing the connecting member (70) into a plurality of sections. A seal ring (80) is associated with one of the sections for engaging with an annular recess (76) located within the propeller hub (74) to provide a substantially tight seal.

16 Claims, 4 Drawing Sheets

LABYRINTH SEAL ADAPTER FOR MARINE PROPELLER

This application claims priority from U.S. Provisional Patent Application No. 60/350,471, filed Nov. 13, 2001.

BACKGROUND OF THE INVENTION

1. Field of the Invention

This invention relates generally to seals, and particularly to labyrinth seals for marine propulsion out-drives, and more particularly to reduce the flow of engine exhaust between the outdrive stationary housing and the rotating propeller hub.

2. Description of the Related Art

A substantial number of marine craft outboard motors, and perhaps an equal number of marine craft using inboard/outboard drives, the engine exhaust is ducted through the lower unit of the outdrive and out through the hub of the propeller. The dimensions of the lower unit housings vary from manufacturer to manufacturer and often require specific dimensioned propellers to provide the proper fit between the propeller hub and the outdrive or lower unit housing. This seal is crucial to prevent exhaust gases from being discharged on the suction side of the propeller blades which reduces propeller efficiency. In the industry, this seal between the propeller hub and the lower unit housing is referred to as a labyrinth seal. Because this seal is important to performance, a large number of propeller models are required to fit the various out-drives. The end result is retailers must invest in substantial inventory to supply replacement propellers. Moreover, purchasers often encounter difficulties finding the proper replacement propeller for their particular drive model.

SUMMARY OF THE INVENTION

The purpose of this invention is to provide an adapter for properly creating the labyrinth seal between a propeller hub and the lower unit of an outdrive. That is to say, for a given propeller, the proper labyrinth seal may be provided by an inexpensive adapter specially configured to match that particular propeller to the outdrive.

The labyrinth seal adapter includes a polymeric ring adapted to be attached to the end of the propeller hub and is configured to seal with the lower unit of the outdrive. In one embodiment, the adapter may be configured to be received over the end of the propeller hub, and alternatively in another embodiment, be received within the end of the propeller hub. The profile of the adapter is such that it provides a transition from the propeller hub end to just inside the end of the outdrive lower unit to direct engine exhaust gases through the propeller hub rather than upstream of the propeller blades.

The advantage is a substantial cost savings achieved by a reduction in inventory. The labyrinth seal adapter is matched with the desired universal propeller to provide the proper seal to a specific manufacturer's lower unit housing configuration.

BRIEF DESCRIPTION OF THE DRAWING FIGURES

DETAILED DESCRIPTION OF THE PREFERRED EMBODIMENTS

Figure 3:
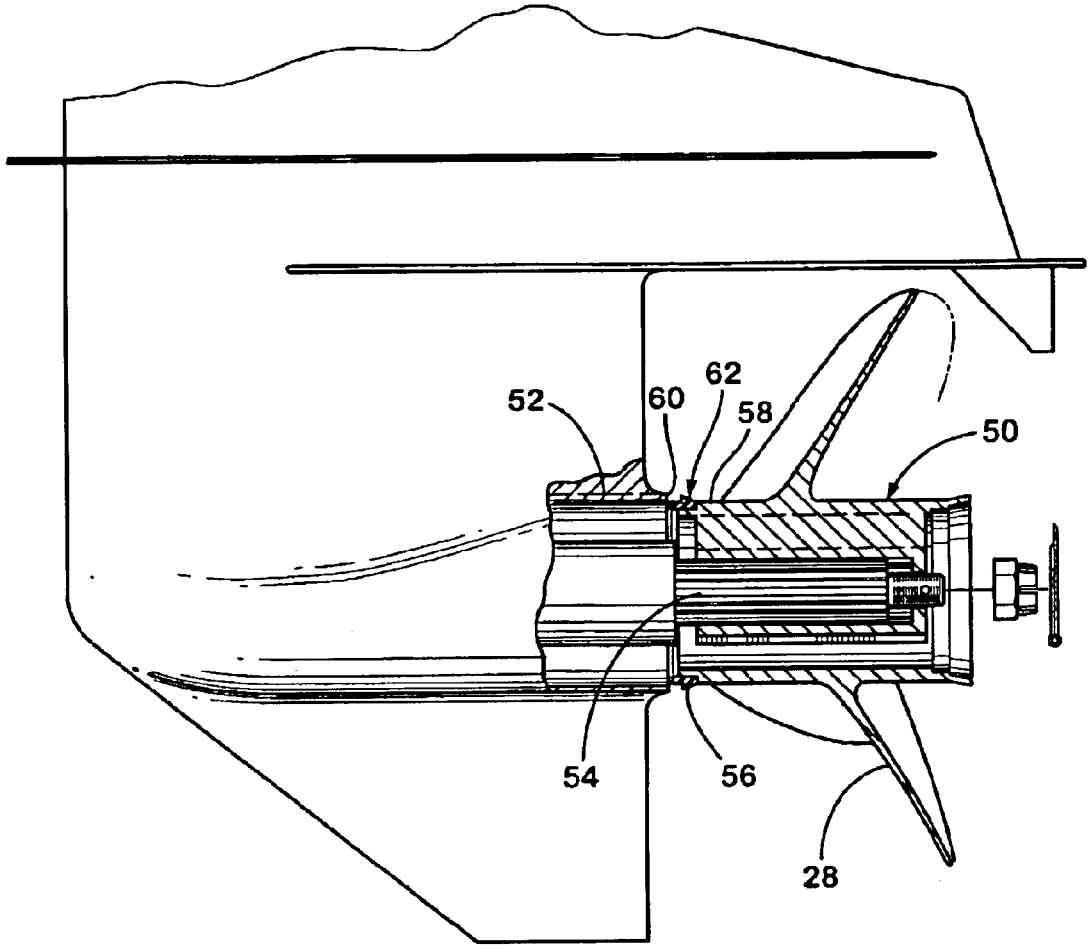
FIG. 3 is a fragmentary section view of a lower unit and a propeller having the labyrinth seal adapter of the instant invention.

For purposed of the following description, the terms "upper," "lower," "right," "left," "rear," "front," "vertical," "horizontal" and derivatives thereof shall relate to the invention as oriented in FIG. 3. However, it is to be understood that the invention may assume various alternative orientations except where expressly specified to the contrary. It is also to be understood that the specific devices and processes illustrated in the attached drawings, and described in the following specification, are simply exemplary embodiments of the inventive concepts defined in the specification and any appended claims. Specific dimensions and other physical characteristics relating to the embodiments disclosed herein are not to be considered as limiting, unless the claims expressly state otherwise.

Referring to the drawing figures, a lower unit 10 of a marine propulsion unit 12 is shown having a propeller 14 attached thereto. An engine (not shown) is provided at an opposite end of the marine propulsion unit 12 for driving the propeller 14 through a transmission (not shown). Driving rotation of the propeller 14 is selectively reversible by means of the transmission to provide for operation of the craft in forward and reverse directions as desired. The exhaust gases from the engine are conducted downwardly though passage 16 in the lower unit 10 for discharge underwater through the hub 18 of the propeller 14. As generally shown in the drawing figures, the propeller 14 is carried by the generally horizontal propeller shaft 20 which is journaled in the exhaust passage 16 contained within housing 22, and projects rearwardly through the opening 24. The horizontal propeller shaft 20 is splined to provide a positive rotational coupling with the propeller hub.

The propeller 14 is separable or independently replaceable relative to the horizontal propeller shaft 20 and includes an outer hub sleeve member 26 which carries the blades 28 and an inner hub sleeve member 30 spaced radially inwardly from and connected to the outer hub sleeve member 26 by one or more circumferentially spaced vanes 32. A number of different mechanisms are now available to couple the inner hub sleeve member to the propeller shaft and will not be discussed in any detail here. However, general reference is made to a semirigid coupling available through Michigan Wheel Corporation which allows the propeller hub to slip with respect to the propeller shaft when the propeller strikes a solid object during rotation. In the alternative, the inner hub sleeve member 30 may have a central cylindrical opening having internal splines configured to mate with and be received along the horizontal propeller shaft 20. For the purposes of completeness, this more rigid and conventional coupling is illustrated.

Figure 1:
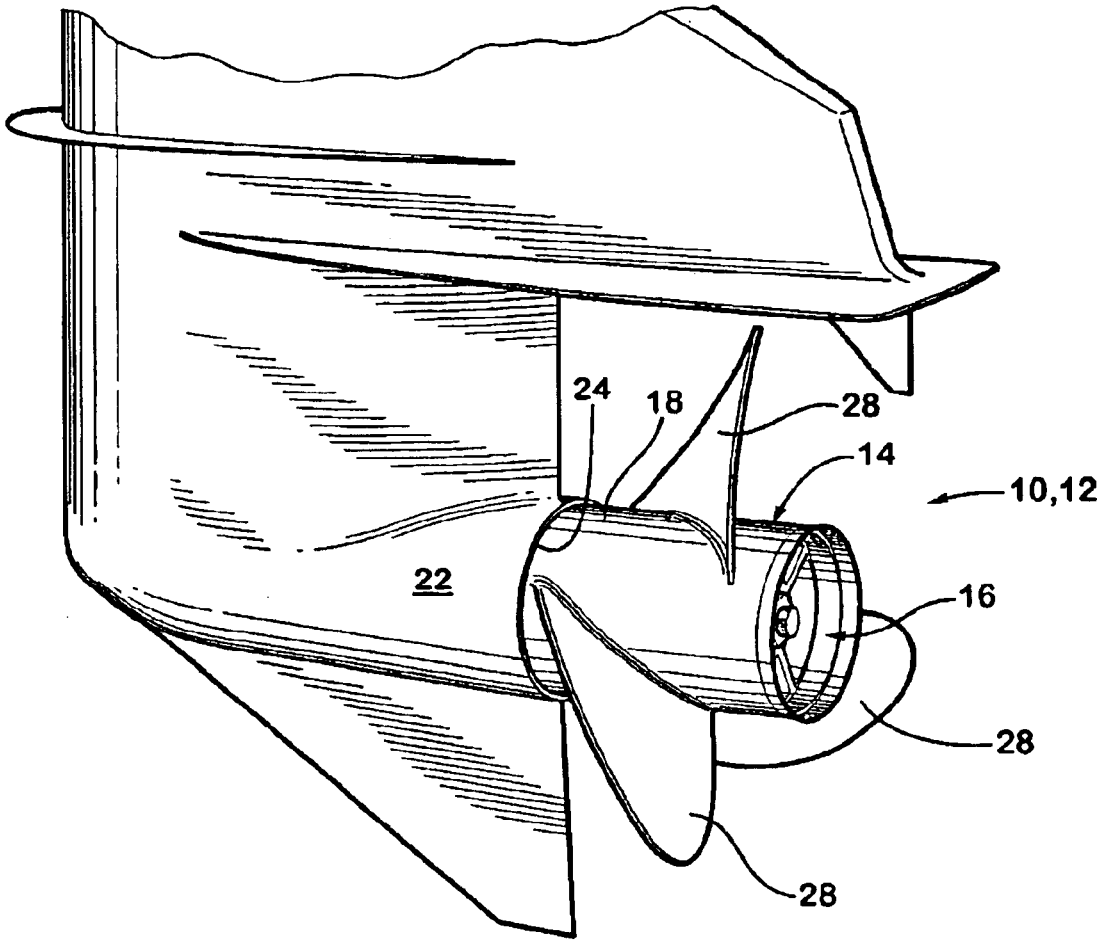
FIG. 1 is a perspective view of a portion of a boat outdrive lower unit and propeller.
Figure 2:
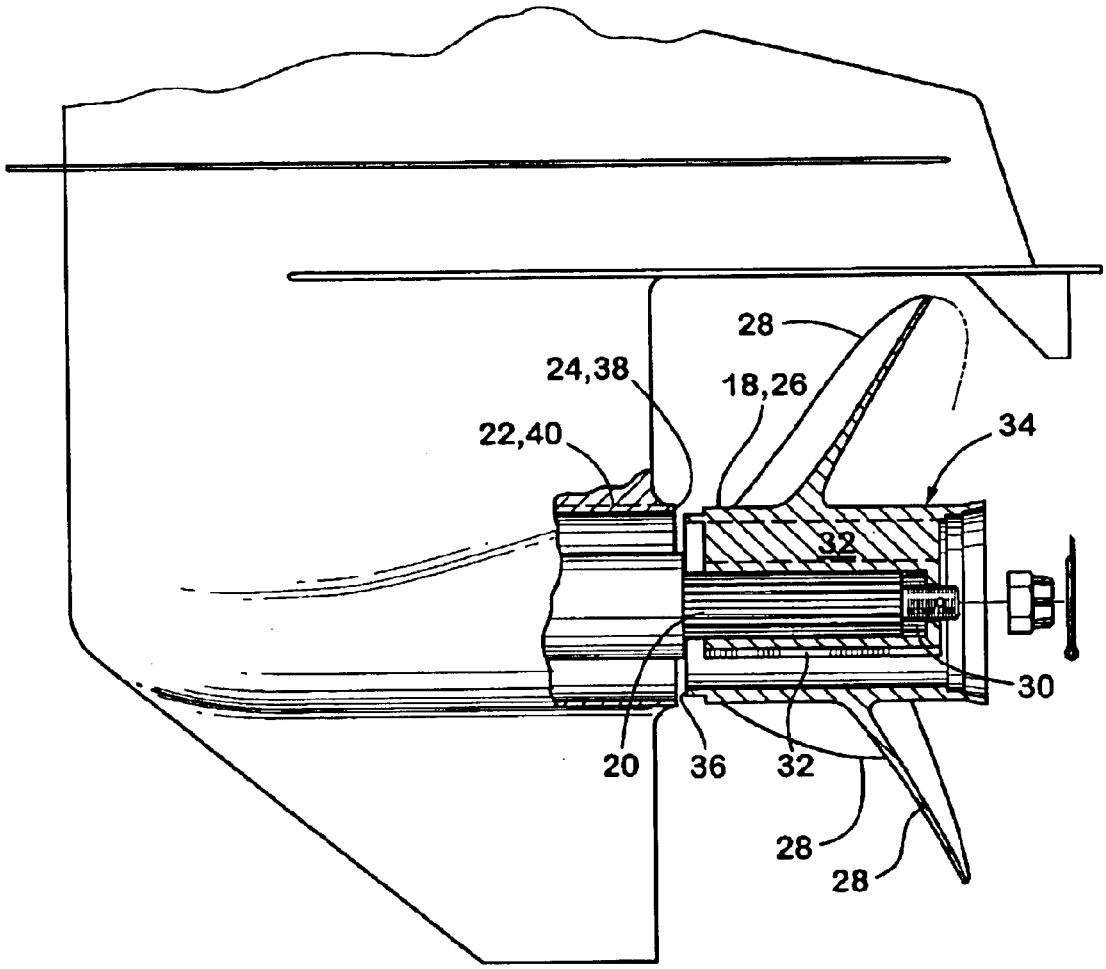
FIG. 2 is a fragmentary section view of the lower unit and propeller shown in FIG. 1.

Referring to FIG. 2, a conventional dedicated propeller 34 is shown which is specially configured such that the outside diameter (O.D.) of propeller end 36 is adapted to be received within the inside diameter (I.D.) of the end 38 of propeller housing 40. The distance the leading end 36 of the propeller 34 is received within and overlaps with the lower unit housing 40 may vary depending upon other characteristics of the marine propulsion unit such as 12, but it is anticipated the end 36 of the propeller may overlap by as little as one-eighth of an inch to as much as one inch with the end 38 of the lower unit propeller housing 40. Moreover, the distance between the O.D. of the propeller end 36, and the I.D. of the lower unit propeller housing 40 may also vary, ranging from as little as one thirty-second of an inch up to one quarter of an inch clearance. However, it is preferred to keep the gap as small as possible in order to keep the pressure differentials up and prevent the exhaust gases from escaping there between.

FIG. 3 illustrates one example where a propeller 50 is not properly dimensioned to mate with the end of the lower unit housing 52. Here, as in FIG. 2, the propeller 50 is shown partially off the propeller shaft 54 to emphasize the difference in size between the leading edge 56 of the propeller hub 58 and the opening 60 of the lower unit housing 52. In this instance, the labyrinth seal may not be formed well enough to prevent the escape of exhaust gases from the lower unit housing 52 and impact propeller performance. One embodiment of a labyrinth seal adapter 62 is shown attached to the leading end 56 of the opening 60 to provide the proper clearances to affect the labyrinth seal function.

Figure 4:
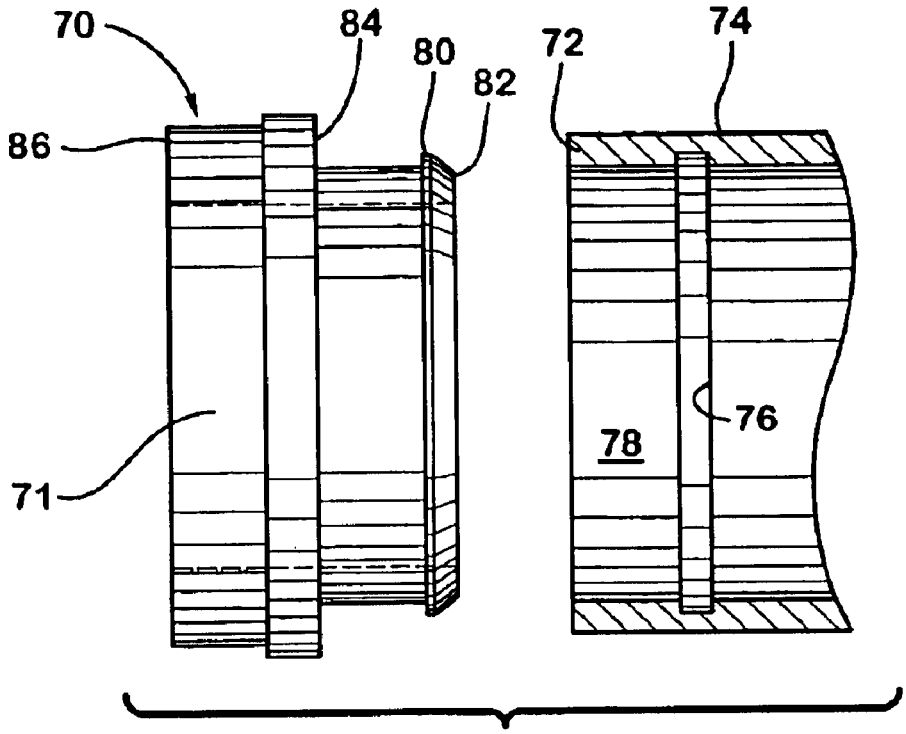
FIG. 4 is a fragmentary section view illustrating one embodiment of the invention and how it is attached to the propeller hub.

FIG. 4 illustrates one example of a labyrinth seal adapter 70 contemplated to be within the scope of the invention where a substantially hollow connecting member 71 is used with the leading end 72 of a propeller hub 74. In this particular embodiment, the propeller hub 74 is manufactured such that an annular recess 76 is defined in the inner diameter hub wall 78 spaced a predetermined distance from the leading end 72 of the propeller hub 74. The annular recess 76 is configured to receive an annular rim or coupling ring 80 formed at one end 82 of the connecting member 71. Spaced a specific distance from the end of the ring 80 is a shoulder 84 configured to provide the transition from the propeller hub 74 providing the labyrinth seal with the opening 60 mentioned above. The shoulder 84 abuts against the leading end 72 to provide a minimal space between the two to restrict the escape of exhaust gases.

The labyrinth seal adapter is manufactured of a semi-flexible material in order to facilitate a tight mechanical seal. Although in the drawing figure it is shown to provide a larger diameter end 86 than the leading end 72 of the propeller hub 74, it should be understood the O.D. of the large diameter end 86 could also be smaller than the leading end 72 of the propeller hub 74 to provide the labyrinth seal with a smaller I.D. of the lower unit housing. The dimensional differences and variations with the transitions may very well be different depending upon the propeller used and the manufacturer of the lower unit housing. As seen in FIG. 4, this embodiment illustrates where the labyrinth seal adapter 70 is received within the I.D. of the propeller hub 74.

Figure 5:
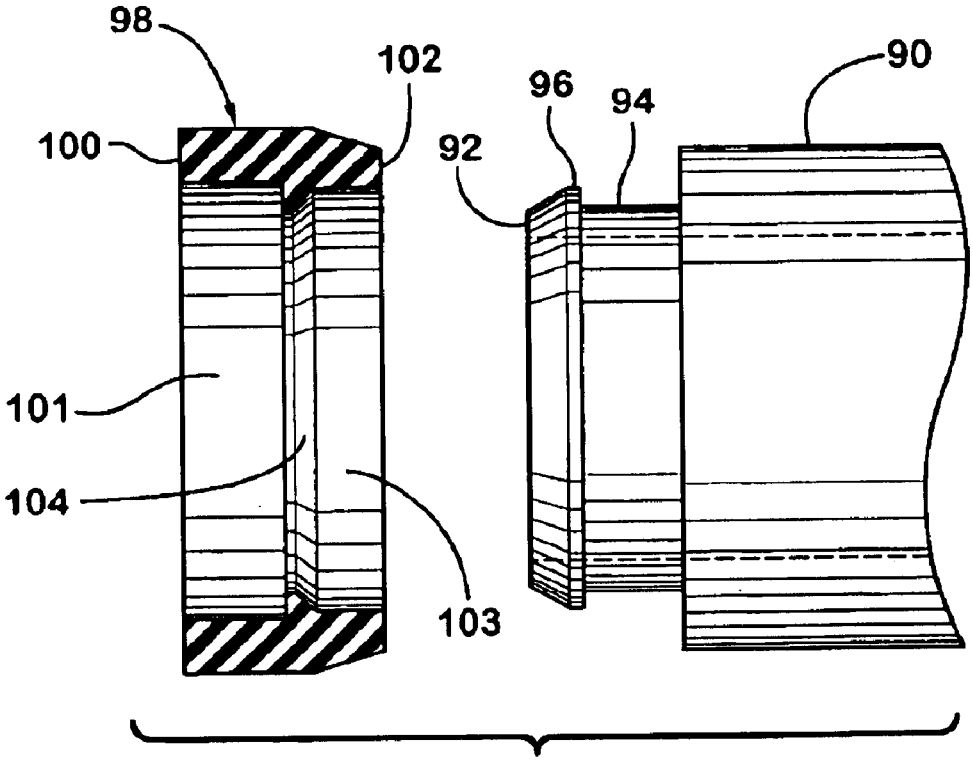
FIG. 5 is a fragmentary section view illustrating another embodiment of the invention and an alternate attachment method to the propeller hub.

FIG. 5 illustrates yet another embodiment where the labyrinth seal adapter may be designed to be attached over the O.D. of the propeller hub. In this embodiment, the propeller hub 90 has a leading end 92 fashioned to have a reduced O.D. cylindrical portion 94 terminating in a truncated conical-like tapered ring or rim 96 of slightly larger O.D., similar to the end of the labyrinth seal adapter 70 described above. In a reversal of components, the labyrinth seal adapter 98 shown in FIG. 5 is preferably formed from a flexible polymeric material housing 100 and has an O.D. which is formed to provide a transition from the propeller hub 90 to the appropriate diameter at the cavity 101 to create the correct labyrinth seal with an outdrive stationary housing (not shown). The internal wall 102 of the cavity 103 of the labyrinth seal adapter 98 includes a tapered annulus 104, located substantially between cavity 101 and cavity 103, adapted to be received over ring 96 and retain the labyrinth seal adapter 98 on the end 92 of the propeller hub 90. Again, as in the previous embodiment, FIG. 5 illustrates an increase in the O.D. of the labyrinth seal to fit a smaller propeller hub with a larger I.D. of the lower unit housing. However, it should again be understood the transition could be a reduction in the diameter of the labyrinth seal to accommodate a larger propeller hub.

As briefly mentioned above, the purpose of the invention is to reduce the number of different model propellers necessary for a dealer to keep in stock. The labyrinth seal adapter provides an inexpensive way to adapt a particular propeller to the correct outdrive unit. The labyrinth seal adapters may be injection molded from polymeric material, or depending upon the particular coupling method, may also be die-cast or formed from powdered metal. In the latter case, screw fasteners may be used to attach the adapter directly to the propeller hub. Polymeric material is at the time of this writing the preferred material as the adapter can be pressure or snap fit onto the propeller hub without the need for screws or other separate mechanical fasteners.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

We claim:

1. A seal adapter for reducing the escape of exhaust gases between a motor housing and one end of a propeller hub, comprising:

a substantially hollow cylindrical connecting member comprised of a polymeric semi-flexible material having a first and a second end; and at least one seal ring defined proximate said first end of said cylindrical connecting member for engaging an end of the motor housing and restrict the escape of exhaust gases from between the propeller hub and the motor housing.

2. A seal adapter as defined in claim 1, wherein at least one of said first and second ends is of a greater diameter than the other.

3. A seal adapter as defined in claim 1, wherein said first end of the cylindrical connecting member is received within the motor housing.

4. A seal adapter as defined in claim 1, wherein said first end of the cylindrical connecting member is received around the motor housing.

5. A seal adapter as defined in claim 1, further comprising a shoulder portion defined on said cylindrical connecting member to lie substantially adjacent an end of the propeller hub.

6. A seal adapter as defined in claim 1, wherein said at least one seal ring has a truncated-conical shape.

7. A labyrinth seal adapter for directing exhaust gases from a motor housing through a marine propeller, comprising;

a substantially cylindrical hollow coupling member;

at least one shoulder surrounding said coupling member for separating said coupling member into a plurality of sections having a first diameter and second diameter; and a least one coupling ring affixed about an end of said coupling member for engaging the marine propeller.

8. A labyrinth seal adapter as in claim 7, wherein an end of said coupling member opposite to said at least one coupling ring is received within said motor housing.

9. A labyrinth seal adapter as in claim 7, wherein an end of said coupling member opposite to said at least one coupling ring is received outside of said motor housing.

10. A labyrinth seal adapter as in claim 7, wherein the labyrinth seal adapter is made of a polymeric semi-flexible material.

11. An adapter seal for restricting the flow of exhaust gases from between a propeller hub and a motor housing, comprising:

a semi-flexible tubular housing having a first end adapted to be at least partially received within an end of the motor housing extending from a motor; and a second end adapted to be attached to an end of the propeller hub.

12. The adapter seal as defined in claim 11, wherein said semi-flexible tubular housing comprises a tapered annulus intermediate said first and second ends.

13. An adapter seal as in claim 11, wherein said first and second end are substantially cylindrical.

14. An adapter as in claim 11, wherein a diameter of said second end is smaller than that of said first end.

15. An adapter as in claim 12, wherein said tapered annulus is sized to accommodate a truncated-conically shaped coupling ring.

16. A method for reducing the escape of exhaust gases between a lower unit of a marine motor and a marine propeller having a universal hub, comprising the step of providing a connecting member having one end adapted to be at least partially received within an end of the lower unit and an opposite end formed to be attached to the hub of the marine propeller to substantially fill any space between the hub of the marine propeller and the lower unit and force the exhaust gases through the propeller hub rather than between the propeller hub and the lower unit.

* * * * *